US008020872B2

(12) United States Patent
Forster

(10) Patent No.: US 8,020,872 B2
(45) Date of Patent: Sep. 20, 2011

(54) BLACKJACK AND POKER GAME COMBINATION

(76) Inventor: Michael Williams Forster, Lomita, CA (US)

( * ) Notice: Subject to any disclaimer, the term of this patent is extended or adjusted under 35 U.S.C. 154(b) by 0 days.

(21) Appl. No.: 12/217,713

(22) Filed: Jul. 7, 2008

(65) Prior Publication Data

US 2008/0272546 A1 Nov. 6, 2008

Related U.S. Application Data

(63) Continuation-in-part of application No. 11/235,813, filed on Sep. 26, 2005, now Pat. No. 7,416,187.

(51) Int. Cl.
*A63F 1/00* (2006.01)

(52) U.S. Cl. ..... 273/292; 463/13; 463/12

(58) Field of Classification Search ..... 273/292, 273/274, 309, 273; 463/12, 13
See application file for complete search history.

(56) References Cited

U.S. PATENT DOCUMENTS

| | | | | |
|---|---|---|---|---|
| 5,678,821 | A | 10/1997 | Hedman | |
| 5,713,574 | A | 2/1998 | Hughes | |
| 6,012,719 | A | 1/2000 | Webb | |
| 6,523,831 | B2 | 2/2003 | Webb | |
| 6,749,200 | B2 * | 6/2004 | Yurkins | 273/292 |
| 6,773,013 | B2 | 8/2004 | Caldwell | |
| 6,854,733 | B2 | 2/2005 | Webb | |
| 6,877,748 | B1 | 4/2005 | Patroni et al. | |
| 2004/0000758 | A1 | 1/2004 | Yurkins | |
| 2004/0090008 | A1 | 5/2004 | Caldwell | |
| 2004/0160006 | A1 | 8/2004 | Kenny et al. | |
| 2004/0239033 | A1 | 12/2004 | Zahedi | |
| 2005/0116414 | A1 | 6/2005 | Yurkins | |

* cited by examiner

*Primary Examiner* — Benjamin Layno
(74) *Attorney, Agent, or Firm* — Roland J. Tong

(57) ABSTRACT

A gaming method is disclosed and comprises the following steps, which need not necessarily be performed in the exact order: allowing a player to play a first poker game using at least two card representations; allowing the player to play a blackjack game using card representations from the first poker game; and allowing the player to play a second poker game using the card representations used in the first poker game and the blackjack game.

20 Claims, 3 Drawing Sheets

BLACKJACK AND POKER GAME COMBINATION

CROSS REFERENCES TO RELATED APPLICATIONS

This application is a continuation-in-part application of U.S. application Ser. No. 11/235,813 filed Sep. 26, 2005 now U.S. Pat. No. 7,416,187.

FIELD OF INVENTION

The present invention relates to methods of playing games of chance, particularly games of Blackjack and Poker.

BACKGROUND

Conventional betting games, such as slot machines, video poker games, and various table games, such as roulette, blackjack, poker, and craps, are the main attractions of casinos and gambling places like Las Vegas, as they have been for many years. Many casino patrons enjoy playing these conventional betting games for many reasons, including the patrons may have developed what they believe to be winning techniques or strategies; they may have become accustomed to the frequency and size of the awards; or, they may have become very well accustomed with the rules. Some of these casino patrons desire some change in these games to add flavor and excitement to these old games and to add new challenges to their gaming experiences. The applicant has discovered ways to modify existing blackjack and poker games in a manner that the applicant believes preserves the attractiveness and familiarity of players with conventional blackjack and poker games while at the same time providing the flavor, excitement, and challenge that casino patrons seek.

Several patents and patent applications disclose modifications to the conventional games of blackjack and poker. For instance, U.S. Patent Application Publication number US 2004/0000758 of Yurkins appear to disclose a game that combines blackjack and poker. The Yurkins patent application involves the players being invited to play either blackjack, poker, or both games, and the players who have opted to play poker are given a total of five cards.

At least one problem with the game disclosed in Yurkins is that it requires the dealer to use substantially more cards than the conventional blackjack game. In the game of blackjack, players often seek high cards, such as kings, jacks, queens, tens, and aces, for their two initial cards to maximize their chances of having two initial cards with the highest possible predetermined value, or to minimize the chances of having to "hit" or obtain an additional card and "busting" or exceeding twenty one. Some players may feel that high cards are being used up quickly in the game of Yurkins, which makes the game of blackjack more favorable to the house. A modified blackjack and poker game that uses fewer cards than the card consumption in Yurkins is desired.

Another problem with the game of Yurkins is that it utilizes five cards to play poker. Blackjack players who are not familiar with conventional five card poker combinations, such as straight, flush, royal flush, and full house, may feel disinterested in learning a game that is substantially different from blackjack. A blackjack/poker game combination that does not require players to be able to form or evaluate conventional five card poker combinations, such as straights, flushes, full house, or variations thereof, is desired.

Yet another problem with the game disclosed by Yurkins is that dealers have to evaluate substantially more winning combinations than the winning combinations involved in conventional blackjack. Thus, Yurkins's game appears to require that the dealers be trained in evaluating both blackjack and five card poker combinations. This poses additional operating cost or overhead expenses to casino operators. Yurkins's game may also require casino operators or dealers to take extra time during each game to evaluate the outcomes of blackjack plus the five card poker. A modified blackjack and poker game that allows dealers to move quickly from one game to another is desired.

Another blackjack/poker combination is disclosed in U.S. Pat. Nos. 6,854,733, 6,012,719, and 6,523,831, which are all issued to Webb. Webb discloses a three card poker and blackjack combination wherein the poker hand consists of two cards that the player obtains from playing blackjack and the card of the dealer that is shown to the player. Webb provides certain definitions of winning three card hands and losing three card hands. Like the problem with the game of Yurkins, the dealers executing the games of Webb may have to be trained with the definitions of winning three card hands and losing three card hands. The dealers may have to take extra time during each game to evaluate the outcomes of blackjack and the three card poker.

From the players' perspective, players may have to get acquainted with these definitions as well. Some players may find the definitions of winning three card hands and losing three card hands overwhelming, and they may be hesitant to learn them. A blackjack/poker game combination that allows both players and dealers to quickly learn and understand the game is desired. Finally, a blackjack/poker game combination that does not substantially have the disadvantages of the references cited above is desired.

BRIEF DESCRIPTION OF THE PREFERRED EMBODIMENTS OF THE PRESENT INVENTION

A gaming method is disclosed and comprises the following steps, which need not necessarily be performed in the exact order: providing at least two card representations to a player, each card representation comprising a symbol, the symbol having a corresponding predetermined value; providing at least two card representations to a dealer, each card representation comprising a symbol, the symbol having a corresponding predetermined value; evaluating a blackjack game outcome by comparing the values of the player and the dealer's card representations, wherein the player wins the blackjack game if the sum of the predetermined values of the player's card representations is higher than the dealer's; using two of the player's card representations for a game of poker; using two of the dealer's card representations for a game of poker; defining values for a plurality of combinations of two card representations; and evaluating a poker game outcome based on the player and the dealer's two card representations, wherein the player wins the poker game when the player possesses a two card combination that has a higher predetermined value than any of the dealer's two card combination. A gaming method is further disclosed and comprises the following steps, which need not necessarily be performed in the exact order: allowing a player to play a first poker game using at least two card representations; allowing the player to play a blackjack game using card representations from the first poker game; and allowing the player to play a second poker game using the card representations used in the first poker game and the blackjack game.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

Figure 1:
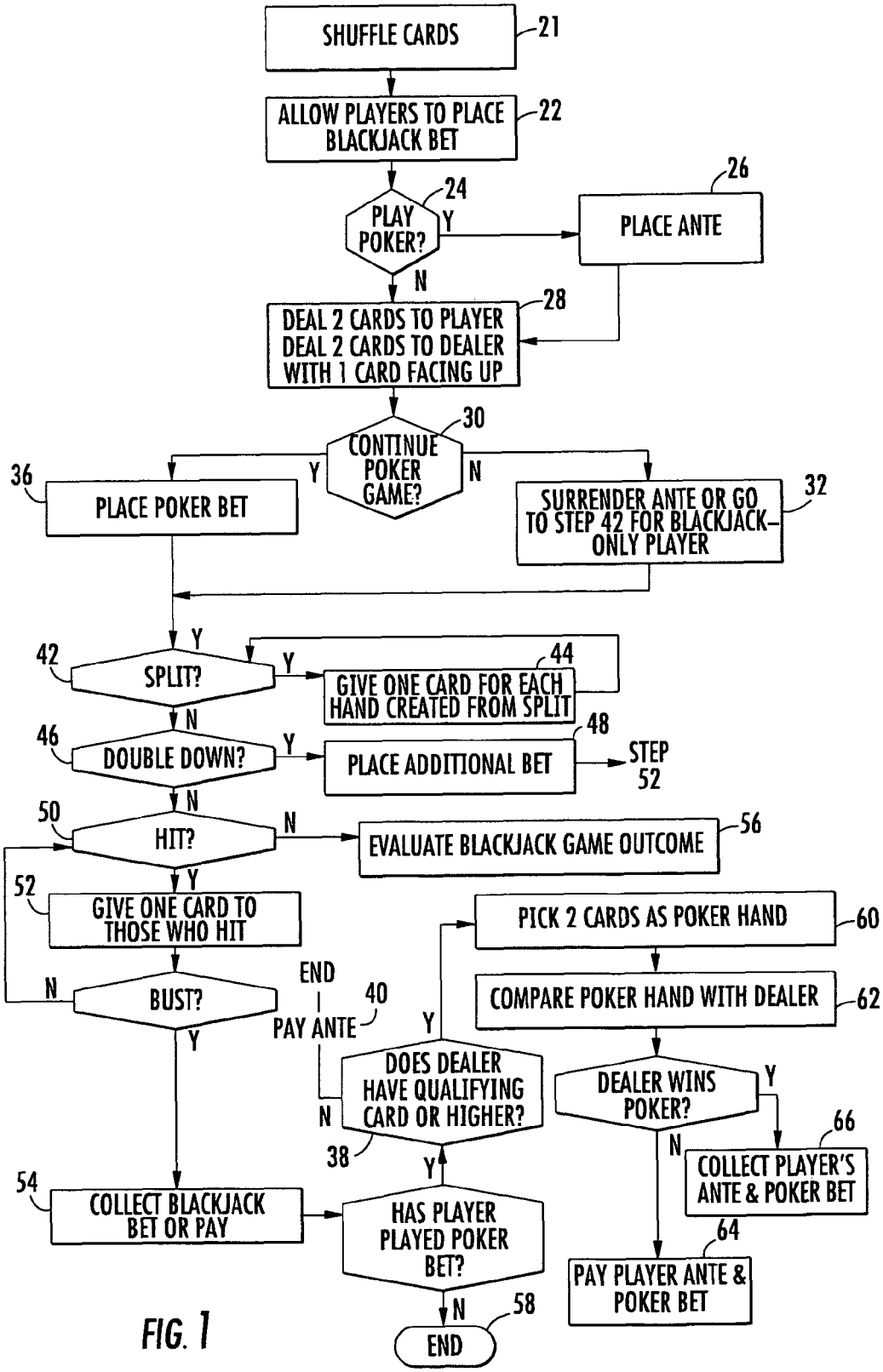
FIG. 1 is substantially a flowchart of one embodiment of the blackjack/poker game combination of the present invention.

The present invention comprises various embodiments of a method of playing a blackjack and poker game combination. Referring to FIG. 1, one embodiment is shown wherein at step 21 a dealer preferably shuffles a plurality of cards. The players may then place their bets for a game of blackjack (step 22). At step 24, the players are preferably invited to play a game of poker. If at least one player wants to play poker, at step 26, the player is preferably required to place an ante.

Regardless of whether any player wants to play poker, the dealer preferably deals two cards to each player and two cards to the dealer. In the preferred embodiment, one of the dealer's cards preferably shows a gaming symbol, such as numbers, suit, or rank, to the players and the dealer (step 28) (hereinafter "face" card). It can be realized that the face card gives some indication to the players of how they will perform against the dealer in both blackjack and poker games. Thus, based on the face card, the players may decide whether to continue playing the poker game at step 30.

For the players that placed an ante for poker, these players preferably have to decide whether to continue playing poker (step 30). If the player decides not to continue playing poker, the ante from step 26 is preferably surrendered to the dealer (step 32). If the player decides to continue playing poker, at step 36, the player is preferably required to place a poker bet, which is preferably equal the ante from step 26. Of course, the proportion between the ante and the poker bet may be modified and still fall within the scope of the invention.

After the player places the poker bet or if the player decided not to play poker, the blackjack game is preferably played. In blackjack, each player preferably competes against the dealer to have a set of cards that has a combined value that is closest to twenty one. The set of cards that is closest to twenty one between one player and the dealer is preferably awarded even money. The combination of either a king, queen, jack, or ten and an ace is preferably awarded 3 to 2. Kings, queens, and jacks preferably have a numerical value of ten. Aces may count either as one or eleven.

The blackjack game is preferably played starting at step 42 wherein the player is asked whether the player wants to split his cards. If the player wants to split his cards, the dealer preferably hands the player one card for each hand created from the split (step 44). In the preferred embodiment, the player may only be allowed to split his cards once. Of course, this rule may be modified and each player may be allowed to split his hands as many times as the player wishes. Next, at step 46, the player may decide whether to double down. If the player decides to double down, the player preferably places his double down bet. One card may then be provided to the player (step 52).

The dealer and the players may be prompted to "hit" or obtain more cards to get closer to twenty one (step 50). In the preferred embodiment, the player who has doubled down is preferably prevented from obtaining more than one card after the double down bet was placed. If a player or a dealer hits, one card is preferably provided to that person (step 52). The dealer preferably may not be allowed to "hit" or has to "stand" when he has a two-card value amounting 17 and the two card value includes a ten, a queen, a jack, or a king. The dealer preferably has to "hit" or obtain at least one more card when the dealer's two-card value is 17 and the dealer's set of cards includes an ace (commonly referred to as a "soft 17"). It is noted that this rule may be preferred when the house wants to take the opportunity to improve the dealer's poker hand by virtue of the extra card that the dealer will obtain from the required "hit."

The player may hit as many times as he wants to get closer to twenty one. However, the player preferably cannot hit anymore once the dealer hits or once the player's turn to hit has passed. If the player stands or busts, the dealer is preferably asked whether to hit or stand (step 50). It is noted that the above rules regarding the ability of the player or the dealer to "hit" are mainly for describing one embodiment of how the invention may be practiced. Other embodiments of playing the blackjack and poker game combination of the present invention may be executed, which may include slight modifications of the above rules. For instance, when the house wants to increase the player's chance for winning the poker game, the above rule may be modified such that the dealers may be required to stand on all 17s even if the dealer's 17 is a soft 17. By virtue of this modification, the dealer waives the opportunity to obtain an additional card that may improve his poker hand. These other embodiments still fall within the spirit and scope of the invention.

Once the dealer is finished hitting by deciding to stand or by busting, the blackjack outcome is preferably determined by comparing the values of the player and the dealer's hand (step 56). The hand that has a value that is closest to twenty one wins. The dealer and the players may "bust" if they exceed twenty one. If a player's blackjack hand busts, the hand loses and the blackjack bet may be collected. Otherwise, the player may be awarded depending on how close the sum of his cards is to twenty one compared to the dealer's cards (step 54).

Next, if no player has placed an ante and a poker bet, the game preferably ends (step 58). It is noted that even if the player or the dealer's blackjack hand busts, the player may continue to play poker if he has placed an ante and a poker bet. If the dealer's blackjack hand busts, but the dealer has a card that is at least as high as the qualifying card, the dealer may also continue to play poker. As used herein, the term "qualifying card" means a card of a particular number, suit, or rank that sets the minimum card value for the dealer to possess in order to participate in the poker game. In the preferred embodiment, the qualifying card is a queen regardless of suit. Thus, the dealer must have a queen or higher to continue playing poker. In other embodiments, the qualifying card may be the card that is determined from statistical studies to provide the optimal advantage to the house. If at least one player has placed an ante and a poker bet, at step 38, the dealer preferably determines whether he has a card that has at least the value of a qualifying card (step 38).

If the dealer does not have at least the value of the qualifying card, the dealer preferably pays the player an amount equivalent to the player's ante (step 40). All the players who have indicated an intention to play poker wins an amount preferably equivalent to the ante, and the poker game preferably terminates. If the dealer has a qualifying card or better, the game of poker is preferably played by selecting preferably the two best cards of each player and the dealer (step 60). The two best cards are preferably the combination that has the highest numerical value, highest rank, or highest pair.

Each player's poker hand is preferably compared against the dealer's poker hand (step 62). The player preferably wins against the dealer if one of the following conditions is met: (1) the numerical value or rank of the player's highest card is higher than the dealer's highest card, (2) the player and the dealer's highest cards are the same in value or rank, but the player's second best card has a higher value or rank than the dealer's second best card, (3) the player has two cards of the same number or rank (hereinafter a "pair") and the dealer has no pair, or (4) the player and the dealer has pairs, but the player's pair has a higher value than the dealer's pair. If the player wins, the dealer preferably pays the player an amount equivalent to the sum of the ante and the player's poker bet (step 64). If the dealer wins, the dealer preferably collects the player's ante and poker bet (step 66).

Figure 3:
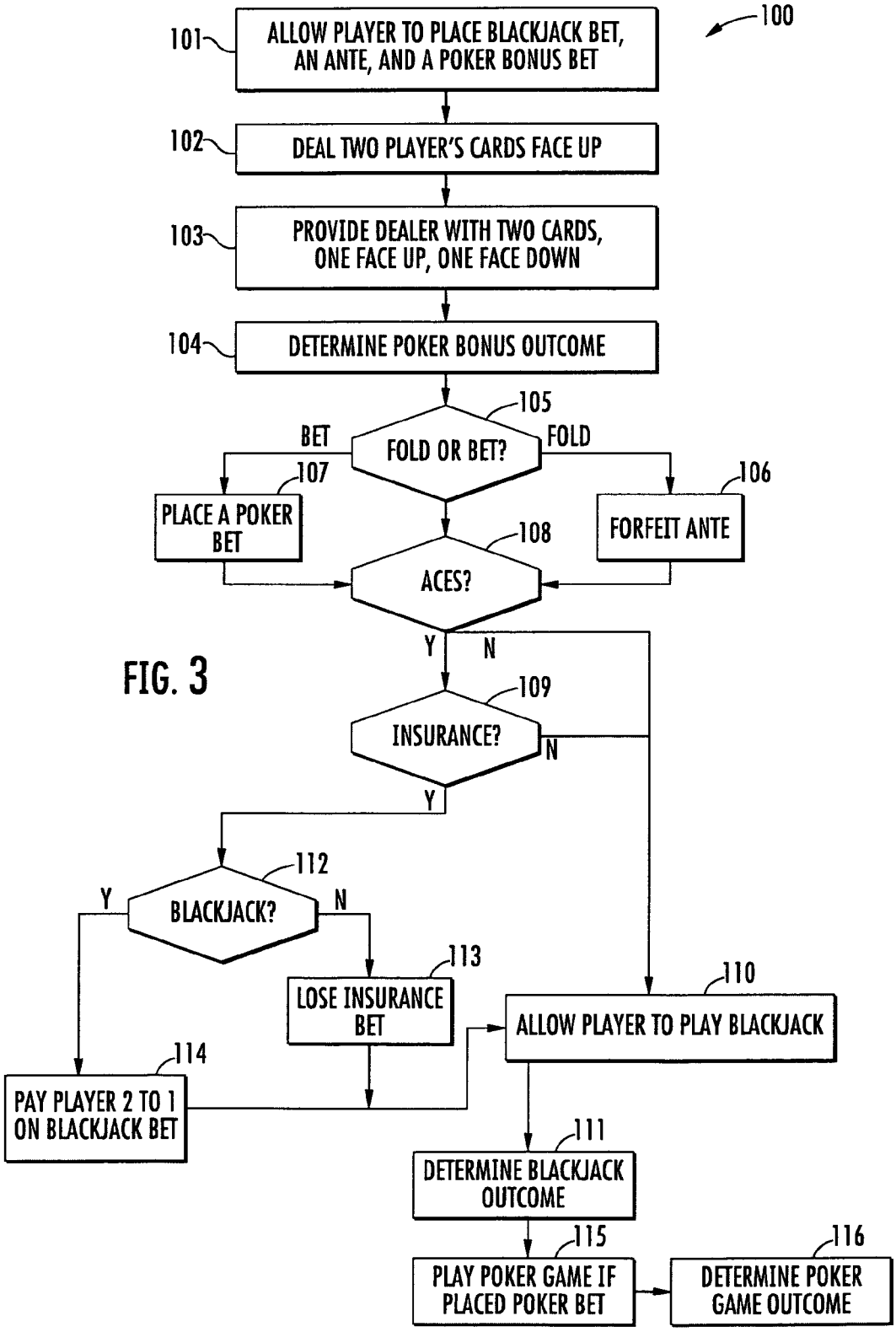
FIG. 3 is substantially a flowchart of another embodiment of the blackjack/poker game combination of the present invention.

Some rules may be established for the blackjack/poker game combination methods. In the preferred method, the rules include: (1) the player preferably must place a blackjack bet and an ante bet to play poker, (2) dealer's first card is preferably positioned so that the symbol is facing up, (3) the poker bet must be twice the ante bet, (4) both players and the dealer may continue to play poker even if the blackjack hand busted, (5) the two cards used for playing the poker are the best two cards in terms of numerical value or rank, (6) dealer must have a queen or higher to qualify for playing poker, (7) players may only play one hand at a time, except when the player splits during blackjack, (8) the player may only split up to four times, (9) dealer must hit on soft 17s, (10) two or six decks of cards must be used, (11) if the poker bonus game embodiment described in FIG. 3 is implemented, six decks of cards are preferably used, and (12) the players are preferably given the option to bet on their poker hands before the dealer checks any hands for a blackjack. These rules may be varied as desired by those implementing the method. For instance, the dealer may be required to stand on all 17s including soft 17s. Traditional blackjack procedures, such as allowing players to buy insurance, preferably apply to the blackjack game of the present invention.

Figure 2:
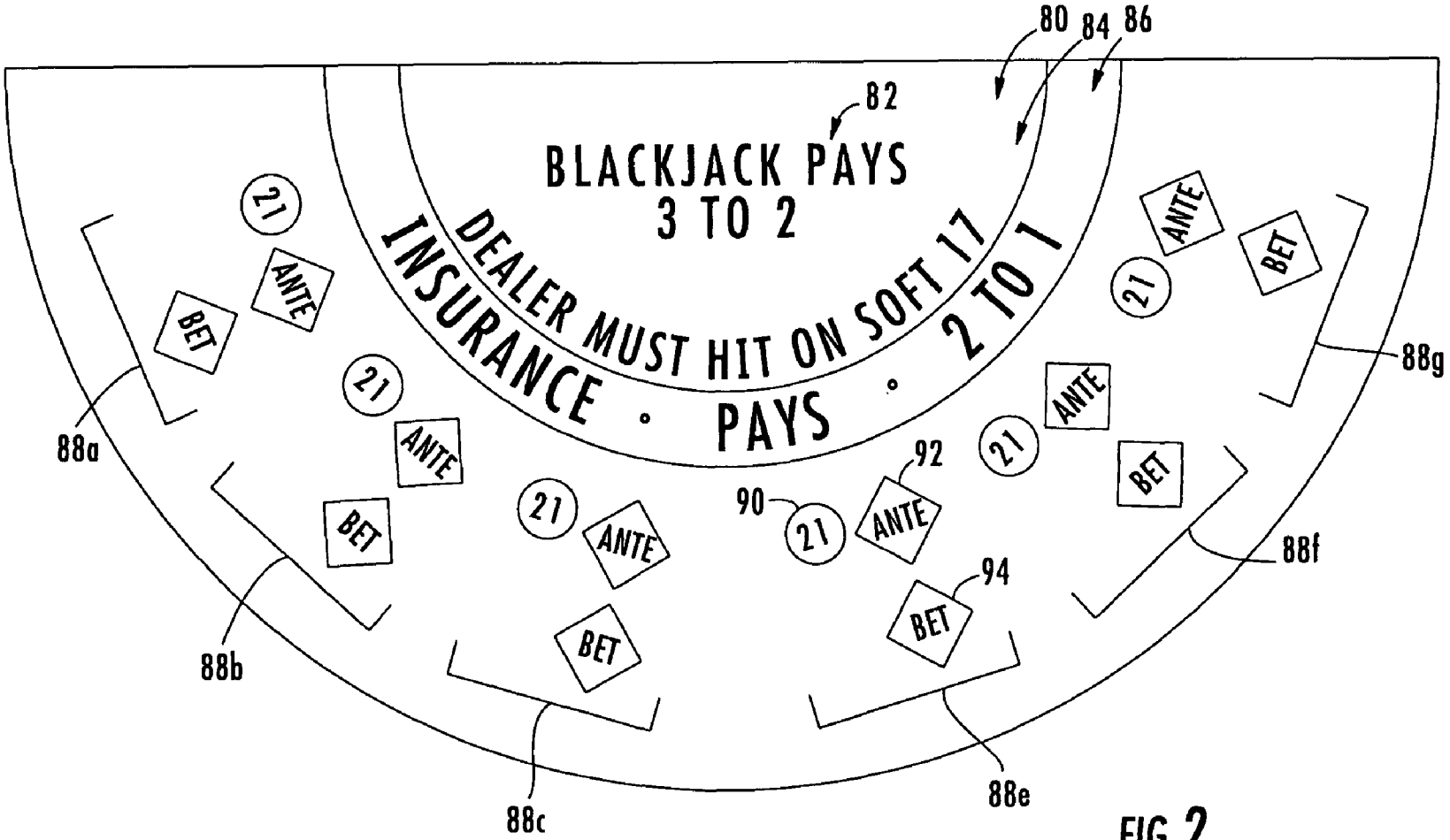
FIG. 2 is substantially a top plan view of a betting layout that may be used to implement a combination blackjack/poker game embodiment.

With reference now to FIG. 2, betting layout 80 may be used to implement the embodiments of the present invention. Betting layout 80 preferably includes a plurality of phrases 82, 84, and 86 that recite some of the rules and some of the awards of the game. For instance, betting layout 80 preferably includes phrase 84, which states "dealer must hit on soft 17." Phrase 82 preferably states "blackjack pays 3 to 2," and phrase 86 preferably states "insurance pays 2 to 1." Of course, the language, positions, and numbers of phrases 82, 84, and 86 may be varied. For instance, if the desired rule is that the dealers must stand on all 17s, phrase 84 may be modified to state "dealer must stand on all 17s."

Betting layout 80 preferably includes a plurality of sets of player betting spots 88*a-g*. The number of sets of player betting spots may be varied. Ideally, seven sets of player betting spots are provided to accommodate up to seven players. Each set of player betting spot preferably includes a blackjack bet position 90, a poker ante position 92, and a poker bet position 94. Blackjack bet position 90 is preferably the position where players place their blackjack bets from step 22. Poker ante position 90 is preferably the position where players place their antes from step 26. Poker bet position 94 is preferably the position where players place their poker bets from step 36. The designs or shapes of bet positions 90, 92, and 94 may be varied. The betting layout 80 may be published on a gaming table, a video screen, or other means of conveying a message to a player.

Another preferred embodiment 100 of a blackjack and poker game combination is shown in FIG. 3. This embodiment preferably includes a poker bonus game in addition to the blackjack and poker games disclosed above and shown in FIG. 1. The game embodiment may be played as follows. At step 101, the player is preferably allowed to place a blackjack bet, an ante, and a poker bonus bet. The blackjack bet is preferably for the blackjack hand. The poker bonus bet is preferably for the poker bonus hand. In the preferred embodiment, if the player wants to play the poker bonus game, the player is preferably required to play the poker hand. Thus, if the player places a poker bonus bet, the player is preferably required to put a wager on the ante. The poker bonus bet may be less than the ante and the blackjack bet, if desired. The player may place only a blackjack bet and only play the blackjack game.

At step 102, the players are preferably dealt two cards face up. The dealer preferably receives two cards-one face up and one face down (step 103). The poker bonus game outcome is preferably determined for the players who have placed a bet for the poker bonus game (step 104). A winning outcome in the poker bonus game is preferably defined as the player having a pair or better. The participating player with a pair may be rewarded the same amount as the player's poker bonus bet. Each bonus game participating player's two cards may also be combined with the dealer's face up card to form a three card bonus poker hand. The bonus game participating player with a three of kind may be rewarded more than the poker bonus bet. The winning participating player is preferably paid only one poker bonus game reward, which is preferably based on the higher of the pair and the three of a kind.

Various levels of bonus game awards may also be predefined depending on the difficulty of obtaining the card combination. For instance, three aces of spades may be given the highest reward followed by three aces of the same suit (diamond, hearts, or clubs), any three of a kind with the same suit, three aces of varying suits, any three of a kind with varying suits, pair of aces with the same suit, pair of aces with varying suits, any pair with the same suit, and any pair with varying suits. The bonus game participating player without the set of predefined winning poker bonus hand preferably loses his poker bonus bet to the dealer.

Next, at step 105, the player is preferably asked whether to play a two card poker by offering two choices to the player—to fold or to bet. If a player chooses to fold, the player preferably loses his ante (step 106). The non-participating player may later be allowed to play a conventional blackjack game after all the participating players have obtained a poker game outcome. Thus, the player may win, lose, or tie the blackjack bet and ante wagers.

Each player's poker hand is preferably composed of the cards dealt to him and does not include any of the dealer's card. If the player chooses to bet on the poker game, then the player is preferably asked to place a poker bet (step 107). The poker bet is preferably the same amount as the ante. It is noted that, in the preferred embodiment, the player is first made to decide whether to play the poker game. The blackjack game preferably follows then the poker game.

To start the blackjack game, the dealer preferably determines whether he can offer insurance (step 109). The dealer preferably checks his hand for any aces (step 108). If the dealer does not have an ace, the players are preferably allowed to play conventional blackjack (step 110). The conventional rules of blackjack for hitting, doubling down, and splitting preferably apply. At step 111, the blackjack outcome is preferably determined the conventional way or as discussed above. If the player wins, the player is preferably rewarded a prize equal to his blackjack bet.

If the dealer has an ace, the dealer preferably has to offer insurance (step 109). If the player declines the insurance, the game preferably resumes to steps 110 and 111. If the player accepts insurance, the player preferably places an insurance bet. The dealer may then check if he has a blackjack (step 112). If the dealer does not have a blackjack, the player preferably loses the insurance bet (step 113). The players may then be preferably allowed to play blackjack (step 110) and a blackjack outcome is preferably determined (step 111).

If the dealer has a blackjack, the player is preferably awarded two times the insurance bet (step 114). The players may then be preferably allowed to play blackjack (step 110) and a blackjack outcome is preferably determined (step 111). After the blackjack outcome is determined (step 111), the poker game, such as the poker game shown in FIG. 1 and described above, may be played by the players who have placed the poker bet (step 115). The poker may be played using the player's and the dealer's best two cards from the blackjack game. The dealer may determine if he has a qualifying card. If he has no qualifying card, the dealer preferably pays each poker game participating player a prize equal to the ante. The poker bet will be a push. If the dealer has a qualifying card, the values of the poker hand of the dealer and the players are preferably compared to obtain a poker game outcome (step 116).

It is noted that if during the blackjack game the player busted and if the player made a poker bet, he may still be allowed to play poker with his busted blackjack hands. The player may pick the best two cards from all the cards he obtained from playing blackjack, including the card that may have lead the player to bust. It is also noted that even if all the players bust their blackjack hands but at least one player made the poker bet, the dealer preferably is required to complete his blackjack hand and then compare his poker hand to the player participating in the poker game. There is preferably no surrender allowed for any of the players and the dealer. In a situation wherein the player decided to split his cards during the blackjack game, the player may be limited to having one poker hand and may be required to use the first two cards the player received from the dealer and not the cards received from hitting during the blackjack game. It is finally noted that the betting layout 80 in FIG. 2 may be modified to include a spot for placing a poker bonus bet.

It can now be realized that the blackjack game of the present invention closely follows the conventional blackjack. Therefore, it can be appreciated that players used to playing traditional blackjack will most likely be attracted to the methods of the present invention, as most of the steps involved in playing traditional blackjack are preserved. These players may also realize that the invention presents them with an opportunity to play additional games along with blackjack. The additional games may provide them with a means of breaking the monotony inherent in traditional blackjack games. The additional games may also provide them with more opportunities to win money. The present invention opens up various winning strategies for players to win either blackjack, poker, or both and encourages the players to use their creativity and imagination.

They are further provided with new challenges that may be easy to understand and meet. These new challenges may not make conventional blackjack fans feel uncomfortable because of unfamiliarity of the rules or unfamiliarity of the ways to win. The traditional blackjack players may realize that the poker component of the present invention may not use any cards that are substantially more than what is needed to play the blackjack component. Players and dealers alike will find that the present invention is easy to understand and play.

From the casino operators' perspective, it can further be appreciated that certain embodiments of the present invention provides more opportunities to encourage wagers from players while at the same time maintains a desirable speed of play. The poker game component of the present invention does not utilize winning combinations associated with the use of traditional five card poker, such as flushes, straights, and full house. The present invention does not utilize complex modifications to traditional five card poker combinations, such as those presented in the Webb patents. Thus, the game outcomes of the present invention are easy and quick to evaluate. Finally, many casino operators may find the difference between number of games that can be played with the present invention per unit of time versus the number of games per unit of time with conventional poker or conventional blackjack alone minimal and acceptable.

Although the description above contains many specifications, these should not be construed as limiting the scope of the invention but as merely providing illustrations of some of the presently preferred embodiments of this invention. For example, the rules pertaining to the number of decks of cards to be used, the required amount of ante and poker bet, and the dealer standing on all 17s may be varied depending on the gaming preference of a casino operator.

The methods of the present invention need not be implemented using traditional cards made out of paper stock. The methods may be implemented on slot machine bonus games, video games, handheld electronic or electromechanical devices, and computers that may generate images of traditional cards. As used herein, the term "card representations"

may be used to refer to real images or artificially generated images of a card having at least a gaming symbol utilized for playing a game of chance.

Some steps may be added or omitted. For instance, bonus features and progressive games may be added to the blackjack/poker combination of the present invention. A bonus feature of rewarding the player if the player possesses a pair of the same suit or rank may be included. The reward may be in a form where the player's poker bet is multiplied, or the reward may be in a form of a progressive prize. The number of players that can be accommodated in a single game may be varied. The invention is capable of other embodiments and of being practiced and carried out in various ways. The invention is not limited in its application to the details of the construction and to the arrangement of the components set forth in the above description or as illustrated in the drawings.

What is claimed is:

1. A method of operating a gaming machine for playing a playing card wagering game comprising the steps of a. providing a gaming machine;

b. providing a non-transitory computer readable medium encoded with instructions and executed by a processor to perform the steps of:

c. providing via a display device a player with two initial playing cards;

d. providing via a display device a dealer with two initial playing cards;

e. allowing the player to play a first poker game;

f. allowing the player to play a blackjack game using at least the two initial playing cards; and g. after the blackjack game is played, allowing the player to play a second poker game, the second poker game comprising the steps of selecting only two playing cards from the player's playing cards in the blackjack game to form a player's second poker hand and selecting only two playing cards from all the dealer's playing cards in the blackjack game to form a dealer's second poker hand, wherein the player wins the second poker game when the player's second poker hand has a higher predetermined value than the dealer's second poker hand.

2. The gaming method of claim 1, wherein in playing the first poker game, the gaming method further comprises:

a. determining whether the player has a pair;

b. providing a prize for the player if the player has a pair.

3. The gaming method of claim 1, wherein in playing the first poker game, the gaming method further comprises:

a. providing via a display device the dealer with at least two playing cards;

b. combining the player's playing cards with one of the dealer's playing cards;

c. providing a prize for the player if the player has a three of a kind.

4. The gaming method of claim 1, further comprising prompting the player to fold or bet on his hand for the second poker game before playing the blackjack game.

5. The gaming method of claim 1, further comprising:

a. allowing the player to hit during the blackjack game;

b. allowing the player to play the second poker game even if the player busted in playing the blackjack game.

6. The gaming method of claim 5, further comprising allowing the player to split during the blackjack game and requiring the player to use first two playing cards the player received in playing the second poker game.

7. A method of operating a gaming machine for playing a playing card wagering game comprising:

a. providing a gaming machine;

b. providing a non-transitory computer readable medium encoded with instructions and executed by a processor to perform the steps of:

c. providing via a display device at least two playing cards to a player;

d. providing via a display device at least two playing cards to a dealer;

e. providing a first win opportunity to the player based on the value of the at least two playing cards provided to the player;

f. playing a blackjack game using the at least two playing cards provided to the player and the at least two playing cards provided to the dealer;

g. providing a second win opportunity to the player if the player wins the blackjack game against the dealer;

h. after the blackjack game is played, playing a poker game using only two of the playing cards from all the playing cards provided to the player in the blackjack game, and only two of the playing cards from all the playing cards provided to the dealer in the blackjack game; and i. providing a third win opportunity to the player if the player wins the poker game against the dealer.

8. The gaming method of claim 7, further comprising:

a. allowing the player to combine the at least two playing cards provided to the player with one of the at least two playing cards provided to the dealer, and b. defining a first win condition to be the condition wherein the combination of the player's playing cards and the dealer's playing cards forms a three of a kind.

9. The gaming method of claim 7, further comprising defining a first win condition to be the condition wherein the player's playing cards forms a pair.

10. The gaming method of claim 7, wherein if the player busts on the blackjack game, the player may still play the poker game.

11. The gaming method of claim 7, wherein the poker game is a two card poker game.

12. The gaming method of claim 7, wherein the poker game does not consider flushes.

13. The gaming method of claim 7, wherein the poker game does not consider full house.

14. The gaming method of claim 7, wherein the poker game does not consider five card combinations.

15. The gaming method of claim 7, wherein the poker game does not consider straights.

16. A method of operating a gaming machine for playing a playing card wagering game comprising the steps of:

a. providing a gaming machine;

b. providing a non-transitory computer readable medium encoded with instructions and executed by a processor to perform the steps of:

c. providing via a display device at least two playing cards to a player;

d. providing via a display device at least two playing cards to a dealer;

e. playing a first game, the first game comprising:

i. combining the player's playing cards with one of the dealer's cards;

ii. rewarding the player if the combination forms a three of a kind;

f. playing a second game using the at least two playing cards provided to the player and the at least two playing cards provided to the dealer; the second game being blackjack, the player and the dealer being allowed to hit during the second game;

g. after the second game is played, playing a third game, the third game comprising the steps of:

i. providing a plurality of two playing card combination values;

ii. determining a two playing card combination, from all the dealer's playing cards in the blackjack game, for the dealer;

iii. determining a two playing card combination, from all the player's playing cards in the blackjack game, for the player; and determining a third game outcome by comparing the values of the two playing card combinations of the dealer and the player.

17. The method of claim 16, wherein in playing the third game, if the player hits during the blackjack game and busts, the third game outcome is determined by comparing the two playing card combinations of the player and the dealer.

18. The method of claim 16, wherein in playing blackjack, the player may split the playing cards provided to the player and in playing the third game, the third game outcome is determined by comparing the two playing card combination of the player and the dealer.

19. The method of claim 16, further comprising rewarding the player in the first game if the combination of the player's playing cards is a pair or better.

20. The method of claim 16, further comprising defining a plurality of payouts for various player card combinations present in the first game.

* * * * *